US006295851B1

(12) United States Patent
Sjostrom

(10) Patent No.: US 6,295,851 B1
(45) Date of Patent: Oct. 2, 2001

(54) METHOD OF MONITORING THE DISTANCE BETWEEN THE ROLLS OF A ROLL PAIR, AND MEANS FOR USE IN CARRYING OUT THE METHOD

(75) Inventor: Bjorn Sjostrom, Ludvika (SE)

(73) Assignee: Morgardshammar AB, Smedjebacken (SE)

( * ) Notice: Subject to any disclaimer, the term of this patent is extended or adjusted under 35 U.S.C. 154(b) by 0 days.

(21) Appl. No.: 09/646,386

(22) PCT Filed: Mar. 17, 1999

(86) PCT No.: PCT/SE99/00419

§ 371 Date: Sep. 18, 2000

§ 102(e) Date: Sep. 18, 2000

(87) PCT Pub. No.: WO99/47285

PCT Pub. Date: Sep. 23, 1999

(30) Foreign Application Priority Data

Mar. 18, 1998 (SE) ..... 9800901

(51) Int. Cl.[7] ..... B21B 37/58

(52) U.S. Cl. ..... 72/10.7; 72/10.1; 72/13.4; 72/365.2

(58) Field of Search ..... 72/10.7, 10.8, 72/237, 250, 10.1, 13.4, 13.5, 365.2

(56) References Cited

U.S. PATENT DOCUMENTS 4,520,674 * 6/1985 Canada et al. ..... 73/660
5,272,443 * 12/1993 Winchip et al. ..... 324/662
5,515,731 * 5/1996 Weisshaar et al. ..... 72/241.4
5,724,846 * 3/1998 Wang et al. ..... 72/237

FOREIGN PATENT DOCUMENTS 2 723 011 2/1996 (FR) .
61-206512 9/1986 (JP) .
1-262014 * 10/1989 (JP) ..... 72/250

* cited by examiner

*Primary Examiner*—Ed Tolan
(74) *Attorney, Agent, or Firm*—Young & Thompson

(57) ABSTRACT

The invention relates to a method of monitoring the distance between the rolls of the roll pairs in a rolling line that includes a plurality of mutually sequential roll units where each unit includes a roll pair and a roller guide for leading a bar section or billet into said unit during a rolling operation. According to the method, the roller guides are provides with vibration measuring means for continuously sensing vibrations in the roller guides. These vibrations are analyzed with respect to frequency, for determining the distance between the rolls of the roll pair that immediately precedes or follows the roller guide.

11 Claims, 3 Drawing Sheets

METHOD OF MONITORING THE DISTANCE BETWEEN THE ROLLS OF A ROLL PAIR, AND MEANS FOR USE IN CARRYING OUT THE METHOD

BACKGROUND OF THE INVENTION

The present invention relates to a method of monitoring the distance between the rolls of roll pairs and the rollers of roller guides of said roll pairs in a rolling line or rolling mill that includes a plurality of mutually sequential roll units, each comprising a roll pair and a roller guide for guiding a bar section, billet or like stock into a respective roll unit, during a rolling operation.

The invention also relates to a device for use when applying the inventive method, and particularly for registering movements in the roller guide that can be later used in the monitoring process.

Rod or shapes are often rolled in a plurality of roll units co-ordinated in a rolling line with the various roll pairs arranged close together, said rolls being arranged in the rolling line in such close relationship as to make visual inspection of the rolling sequence between the roll pairs impossible to carry out. It is also possible that parts of the rolling line are enclosed in a protective casing in order to prevent cooling water from splashing from the rolls into the surroundings, among other things, which also makes inspection of the rolling result between the roll pairs impossible to carry out.

Consequently, the rolling result cannot be assessed until the rod/shape has left the rolling line, and then solely by a visual examination of the rolled product leaving said rolling line. If an adjustment needs to be made, it may be necessary to stop the rolling process so as to enable a manual adjustment to be made to one of the rolls, for instance. Hitherto, no method has been proposed by means of which a maladjusted roll in a roll unit can be determined directly. Instead, the adjustment has been made essentially with a starting point from past experiences of the machine operator and the adjustment is normally made at the place where the adjustment is expected to give the intended result.

SUMMARY OF THE INVENTION

Accordingly, the object of the present invention is to provide a method and means which enable the distance between the rolls of respective roll units to be monitored during a rolling operation and as a consequence thereof also to be adjusted, so as to obtain a rolled product of high and uniform quality.

The aforesaid objects have been achieved with a method and means having the characteristic features set forth in respective associated Claims.

The invention is based on continuously sensing vibrations in the roller guides and analysing their frequency and possibly also their amplitude, so that changes in certain frequencies can be used to give an indication of the state in the roll pair that precedes the roller guide and possibly also in the roll pair that lies downstream of the roller guide in the feed direction of the stock.

BRIEF DESCRIPTION OF THE DRAWINGS

The invention will now be described in more detail with reference to non-limiting embodiments thereof and with reference to the accompanying drawings, in which.

DESCRIPTION OF THE PREFERRED EMBODIMENTS

Figure 1:
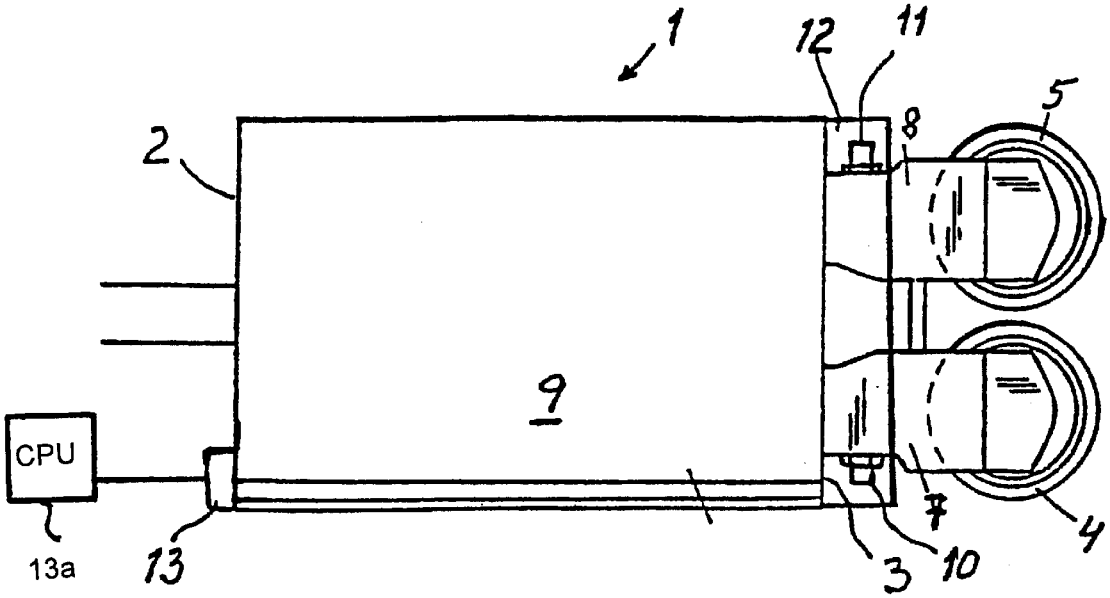
FIG. 1 illustrates from above a roller guide for a roll pair provided with registering means for application of the inventive method when rolling round rod.
Figure 2:
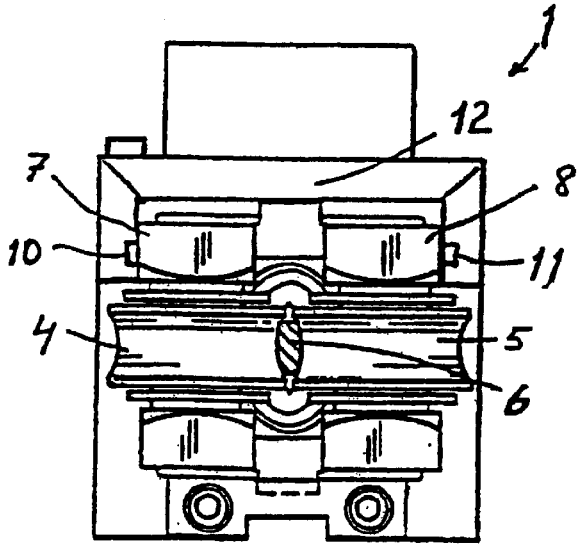
FIG. 2 is an end view of the roller guide shown in FIG. 1.

FIG. 1 illustrates a typical roll guide for use in rolling mills or lines and having an infeed end 2 and a guide end 3. The guide end 3 typically includes two grooved and rotatable rollers 4 and 5 which guide the stock 6 therebetween during the rolling process (see FIG. 2). The rollers 4 and 5 are carried by arms 7, 8 fixed to the holder 9 of the roller guide.

Vibration sensors 10 and 11 are each screwed into a respective roller arm 7, 8 and protected by a protective casing 12 attached to the holder at the guide end 3 of the roller guide. The vibration sensors 10 and 11 are adapted to sense vibrations in the arms 7 and 8 and are connected by signal cables to an electric contact 13 to which a signal cable can be connected for conducting said signals to a process unit 13*a*, for instance to a computer equipped with software for automatically analyzing the signals incoming from the sensors 10 and 11.

Figure 3:
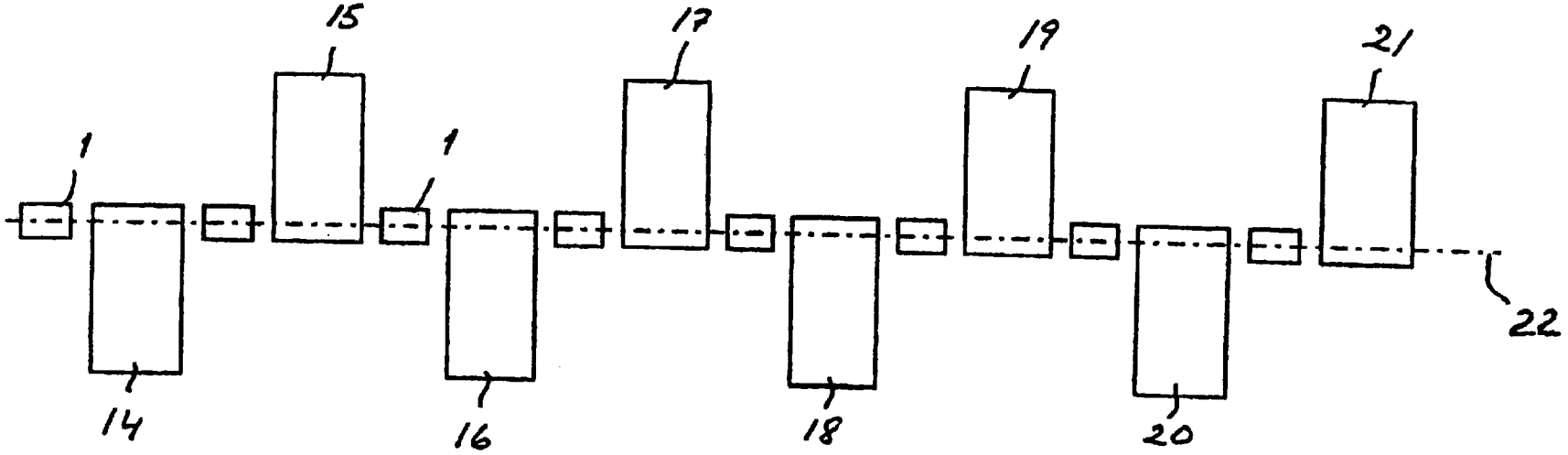
FIG. 3 is a schematic illustration of part of a roll line having eight roll pairs in which the inventive method can be applied.

A rolling line, or rolling mill, can include a plurality of mutually sequential roll pairs where each alternate roll pair rolls the rod to an oval shape and each other alternate roll pair rolls the rod to a round shape. FIG. 3 is a highly schematic illustration of an example of part of such a rolling line that includes eight roll pairs 14, 15, 16, 17, 18, 19, 20, 21, of which the roll pairs 14, 16, 18 and 20 roll the rod to a round shape while the roll pairs 15, 17, 19 and 21 roll the rod to an oval shape. The chain line 22 drawn in FIG. 3 indicates the rolling line through which the rod is moved during a rolling operation. A roller guide 1 is provided upstream of each of the roll pairs 14, 16, 18 and 20, i.e. the roll pairs that roll the rod to a round shape. Alternatively, one such roller guide can be provided at each roll pair in the rolling line. All of the roller guides 1 will conveniently be provided with vibration measuring means that enable the inventive method to be applied. The rolls of respective roll pairs can be adjusted relative to each other in a known manner, such as to enable the distance between the rolls of a respective roll pair to be either increased or decreased, because of wear on the rolls on the one hand and also because of differing qualities of the material to be rolled on the other hand.

When the vibration measuring means are used to monitor the state of the rolls, vibrations occurring in the arms 7 and 8 of the roller guides are analysed by frequency analysis. In the case of frequency analysis, vibrations deriving from normal rotation of the rolls, the frequencies of which can be established when the speed at which the stock is advanced and the width and diameter of respective rolls is known, can be sorted out from the analysis and changes in other, selected, frequencies can be used as a measurement of the load on the roll pair concerned. Frequencies deriving from other control points in the rolling line or rolling mill can be analysed and excluded from the analysis during operation of the plant. By studying the frequency changes obtained with a given roller guide as a result of a change in the distance between the rolls of a preceding and following roll pair respectively, it is possible to obtain for each roller guide threshold values corresponding to certain frequencies and to allow these threshold values to provide an indication as to whether or not the rolls function in the manner intended.

Figure 4:
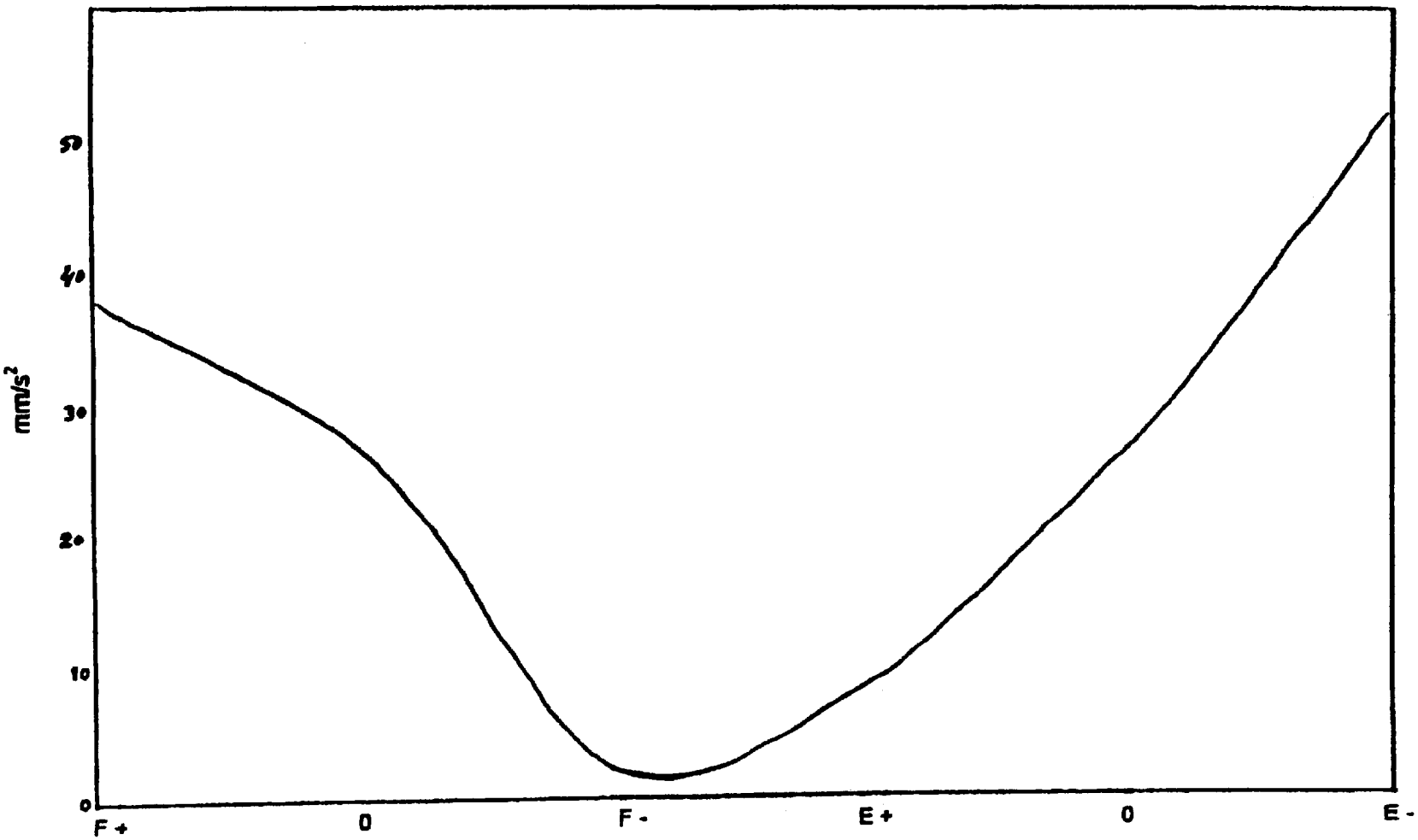
FIG. 4 is an example of a vibration level curve obtained with different adjustments of preceding and following roll pairs in a rolling line.

Trials have been run in which it was observed that changed results are obtained both in the event of a change in the distance between the rolls of the roll pair that preceded the roller guide and also in the event of a change in the distance between the rolls of the roll pair that followed the roller guide concerned. FIG. 4 is a diagrammatic illustration that shows how the vibration level (in this case the acceleration) changes in a roller guide at the selected frequencies as a result of a change in the distance in the preceding roll pair (F) and also in the following roll pair (E). In the diagram, there is shown at 0 the vibration level in a normal setting of the roll pairs, and with – and + there is shown the vibration level when the distance between the respective pairs of rolls decreases and increases respectively. In addition to acceleration, the vibration measuring process can also be carried out with respect to speed or movement.

After manually testing the rolling mill or rolling line and carrying out a frequency analysis for each of the roller guides and their rollers with a change in the setting of the distance between the roll pairs upstream and downstream of respective roller guides, there can be established threshold levels at which there is delivered a signal indicating that an adjustment needs to be made. Those frequencies that originate from rotation of the rolls and the advancement of the rod can then also be sorted out in the frequency analysis. This can be readily achieved with the aid of computer technology. For instance, the values that caused the signal to be sent can be presented on a computer screen and therewith enable the roll pair requiring adjustment to be manually adjusted.

Data obtained from the aforedescribed frequency analysis can also be presented by continuously presenting the vibration levels of respective sensors on a computer screen in the form of stack diagrams, where different vibration levels are given in different colours so as to enable deviations from a normal state to be easily observed.

When a frequency analysis has been made and the basic setting values have been obtained in accordance with the aforegoing, the processing computer may be coupled to means for setting the respective roll pairs in the rolling line.

The vibration sensors used may conveniently be piezoelectric accelerators that sense all movements, in this case their own movement and also movement of the rollers and the arms, and that deliver a signal whose strength is proportional to the acceleration. The vibration sensor retailed under the designation 353 B67 by Piezotronics Inc., U.S.A., is an example of one type of vibration sensor that can be used to this end.

In addition to being used for the aforesaid purpose, the vibration sensors may also be used in a known manner to detect wear in the roll bearings. This enables faults to be detected and an alarm raised with the same equipment as that used to monitor the distance between the rolls, therewith enabling unplanned interruptions in operation to be prevented when the faults are detected in time. The inventive method can also be applied to detect faults in the setting of the roll pair per se and also in relation to said roll pair, and also enables direct damage to a roll caused by a fault in the rolled material to be detected. Other faults in the roll unit caused by wear on the rolls and the rollers can be detected by monitoring changes in the frequencies generated by said rolls and rollers.

What is claimed is:

1. A method for monitoring the distance between the rolls of roll pairs in a rolling line that includes a plurality of sequentially arranged roll units where each roll unit includes a pair of rolls and a roller guide for leading the stock into said roll unit during a rolling operation, characterized by providing each of the roller guides with vibration measuring means, and by continuously reading the signals delivered by the vibration measuring means and carrying out a frequency analysis to determine the distance between the rolls in the roll pair that immediately precedes and/or immediately follows said roller guide.

2. A method according to claim 1, characterised by adjusting the distance between the rolls of the roll pair that immediately precedes and/or immediately follows the roller guide, in accordance with the frequency analysis carried out.

3. A method according to claim 1, characterised by carrying out the method separately for each roll unit of a rolling line that includes several roll units.

4. A method according to claim 1, characterised by also using the signals obtained from the vibration measuring means, subsequent to said frequency analysis, for detecting wear and other faults in rolls and/or roller guides.

5. An arrangement for use in carrying out the method according to claim 1, where a rolling line, or rolling mill, includes a plurality of mutually sequential roll units which each include a roll pair and a roller guide for leading a bar section, billet or like stock into an associated roll unit, characterised in that each roller guide (1) is equipped with at least one vibration measuring means (10, 11) which is connected by signal cables to a signal processing device.

6. An arrangement according to claim 5, characterised in that the roller guide (1) includes two or more rollers (4, 5) carried by arms (7, 8); and in that a vibration measuring means (10, 11) is provided on each arm (7, 8).

7. An arrangement according to claim 6, characterised in that the vibration measuring means (10, 11) is screwed into threads provided in the arms (7, 8).

8. An arrangement according to claim 6, characterised in that the vibration measuring means (10, 11) are piezo electric accelerators.

9. A method of monitoring a distance between a pair of rolls in a roll unit that also includes a roller guide that leads stock into the roll unit during a rolling operation, the method comprising the steps of:

continuously measuring vibrations of the roller guide;

analyzing frequencies of the vibrations; and determining the distance between the pair of rolls based on the frequency analysis.

10. The method of claim 9, further comprising the step of adjusting the distance between the rolls based on the determined distance.

11. A roll unit for a rolling line, the roll unit comprising:

a pair of rolls;

a roller guide that leads stock into said pair of rolls during a rolling operation:

a vibration measuring device that measures vibration of the roller guide; and a signal processing device for analyzing frequencies of the vibrations from said vibration measuring device and for determining a distance between rolls in said pair of rolls based on the frequency analysis.

* * * * *